US009108418B2

(12) United States Patent
Kanbe et al.

(10) Patent No.: US 9,108,418 B2
(45) **Date of Patent: *Aug. 18, 2015**

(54) ADAPTOR

(71) Applicant: Brother Kogyo Kabushiki Kaisha, Nagoya-shi, Aichi-ken (JP)

(72) Inventors: Tomohiro Kanbe, Nagoya (JP); Yuki Takagi, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/456,504

(22) Filed: Aug. 11, 2014

(65) Prior Publication Data

US 2015/0022597 A1 Jan. 22, 2015

Related U.S. Application Data

(63) Continuation of application No. 13/843,348, filed on Mar. 15, 2013, now Pat. No. 8,833,905.

(30) Foreign Application Priority Data

Mar. 30, 2012 (JP) ..... 2012-082666

(51) Int. Cl.
*B41J 2/175* (2006.01)
*B41J 29/393* (2006.01)

(52) U.S. Cl.
CPC ..... *B41J 2/17526* (2013.01); *B41J 2/17513* (2013.01); *B41J 2/17566* (2013.01)

(58) Field of Classification Search
USPC ..... 347/19, 49, 50, 86
See application file for complete search history.

(56) References Cited

U.S. PATENT DOCUMENTS 5,250,957 A * 10/1993 Onozato ..... 347/7
5,552,816 A * 9/1996 Oda et al. ..... 347/86
5,788,388 A * 8/1998 Cowger et al. ..... 400/703
5,844,580 A 12/1998 Barinaga et al.

(Continued)

FOREIGN PATENT DOCUMENTS

CN 102161278 A 8/2011
EP 1905594 A1 4/2008
JP 2009-132098 A 6/2009

OTHER PUBLICATIONS

State Intellectual Property Office of the People's Republic of China, Notification of First Office Action issued for Chinese Patent Application No. 201310104784.8 (foreign counterpart to above-captioned patent application), mailed Sep. 4, 2014.

(Continued)

*Primary Examiner* — Anh T. N. Vo
(74) *Attorney, Agent, or Firm* — Baker Botts L.L.P.

(57) ABSTRACT

An ink containing device includes an ink cartridge and an adaptor. The ink cartridge comprises a first main body comprising a chamber configured to store ink, and an ink outlet portion disposed on a first surface of the first main body configured to direct the ink from the chamber to an exterior of the first main body, and an ink detecting portion configured to detect an amount of the ink stored in the ink chamber. The adaptor is configured to attach to the ink cartridge. The adaptor comprises a second main body comprising a second surface, and an electrical interface disposed on the second surface.

18 Claims, 9 Drawing Sheets

(56) References Cited

U.S. PATENT DOCUMENTS

| | | | | |
|---|---|---|---|---|
| 6,130,695 | A | 10/2000 | Childers et al. | |
| 6,322,205 | B1 | 11/2001 | Childers et al. | |
| 6,488,369 | B1 | 12/2002 | Steinmetz et al. | |
| 6,767,075 | B1 * | 7/2004 | Takada et al. | 347/19 |
| 6,832,830 | B2 | 12/2004 | Seino et al. | |
| 6,945,642 | B2 * | 9/2005 | Yamamoto et al. | 347/86 |
| 7,118,194 | B2 | 10/2006 | Matsuo et al. | |
| 7,562,972 | B2 | 7/2009 | Hattori et al. | |
| 7,625,077 | B2 | 12/2009 | Shinada et al. | |
| 2006/0268077 | A1 | 11/2006 | Shinada et al. | |
| 2009/0322835 | A1 | 12/2009 | Kanbe et al. | |
| 2009/0322836 | A1 | 12/2009 | Kanbe et al. | |

OTHER PUBLICATIONS

State Intellectual Property Office of the People'S Republic of China, Notification of Second Office Action issued for Chinese Patent Application No. 201310104784.8 (foreign counterpart of parent application of above-captioned patent application), mailed May 7, 2015.

* cited by examiner

ADAPTOR

CROSS-REFERENCE TO RELATED APPLICATION

This application is a continuation of U.S. patent application Ser. No. 13/843,348 filed on Mar. 15, 2013, which claims priority from Japanese Patent Application No. 2012-082666 filed on Mar. 30, 2012, the entire subject matter and disclosures of which are incorporated herein by reference in their entirety.

BACKGROUND OF THE INVENTION

1. Field of the Invention

The invention relates generally to an ink containing device comprising an ink cartridge and an adaptor, and an ink supply device.

2. Description of Related Art

A known image recording apparatus records an image on a recording sheet using ink. The image recording apparatus includes an inkjet recording head and selectively ejects ink droplets from nozzles of the recording head onto a recording sheet. The ink droplets land on the recording sheet to record a desired image on the recording sheet. The image recording apparatus includes an ink cartridge storing ink therein to supply ink to the recording head. The ink cartridge is removably out mounted to a cartridge mounting portion provided in the image recording apparatus.

The ink cartridge may include an electronic component, e.g., a memory module, to store data relating to ink color, ink material, a residual amount of ink, and a maintenance condition. The memory module is electrically connected with a contact disposed on the mounting portion when the ink cartridge is mounted to the cartridge mounting portion. Data stored in the memory module may be read via the contact. The memory module is provided on an adaptor and an ink cartridge is removed from the mounting portion while the adaptor remains in the mounting portion. Because the memory module remains in the mounting portion, the data stored in the memory module is not renewed or updated when the ink cartridge is replaced.

SUMMARY OF THE INVENTION

The invention may provide a ink containing device comprising an adaptor and a an ink cartridge, and an ink supply device in which information may be renewed or updated.

According to an embodiment of the invention, an ink containing device comprising: an ink cartridge comprising: a first main body comprising a chamber configured to store ink, and an ink outlet portion disposed on a first surface of the first main body configured to direct the ink from the chamber to an exterior of the first main body, wherein the first surface faces a first direction, and an ink detecting portion configured to detect the ink stored in the ink chamber; and an adaptor configured to attach to the ink cartridge, the adaptor comprising a second main body comprising a second surface, and an electrical interface disposed on the second surface.

According to another embodiment of the invention, an ink containing device, comprising: an ink cartridge comprising: a first main body comprising a chamber configured to store ink, and an ink outlet portion disposed on a first surface of the first main body configured to direct the ink from the chamber to an exterior of the first main body, and a light attenuating portion protruding from the first surface; and an adaptor configured to attach to the ink cartridge, the adaptor-comprising a second main body comprising a second surface, and an electrical interface disposed on the second surface.

According to still another embodiment of the invention, an adaptor, comprising: a main body comprising a particular surface facing a particular direction and a further surface facing a further direction, and an electrical interface disposed on the particular surface; wherein a first opening and a second opening are formed in the further surface.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Figure 1:
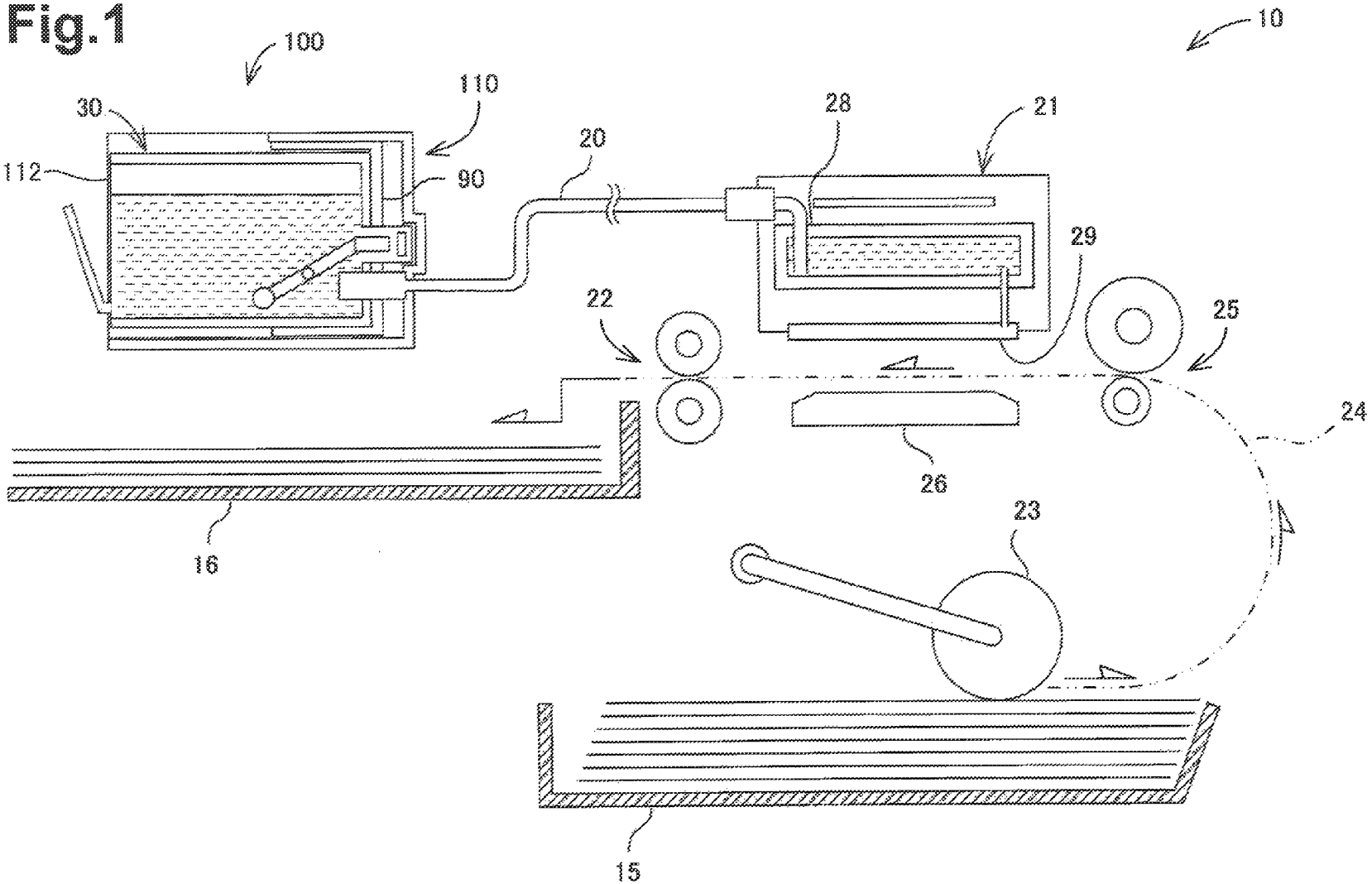
FIG. 1 is a schematic side view of a printer according to an embodiment of the present invention.

Example embodiments are described in detail herein with reference to the accompanying drawings, like reference numerals being used for like corresponding parts in the various drawings.

Referring to FIG. 1, a printer 10, e.g., an inkjet recording apparatus, may be configured to record an image by selectively ejecting ink droplets onto a recording sheet. The printer 10 may comprise a recording head 21 and an ink supply device 100. The ink supply device 100 may comprise a cartridge mounting portion 110. The cartridge mounting portion 110 may be configured to receive an ink cartridge 30 and an adaptor 90. The cartridge mounting portion 110 may have an opening 112 formed therethrough. The ink cartridge 30 and the adaptor 90 may be selectively inserted into or removed from the cartridge mounting portion 110, via the opening 112. The ink cartridge 30 and the adaptor 90 may correspond to an ink containing device.

The ink cartridge 30 may be configured to store ink for use in the printer 10. When the ink cartridge 30 is mounted to the cartridge mounting portion 110, the ink cartridge 30 may be in liquid communication with the recording head 21 via a flexible tube 20. The flexible tube 20 may be connected to the cartridge mounting portion 110 at one end and to the recording head 21 at the other end. A sub-tank 28 may be positioned in the recording head 21. The sub-tank 28 may be configured to temporarily store ink supplied from the ink cartridge 30 via the flexible tube 20 and to supply ink to nozzles 29 of the recording head 21. The recording head 21 may be configured to selectively eject ink from the nozzles 29.

Recording sheets may be picked up one at a time from a sheet tray 15, by a pick-up roller 23 and conveyed to a conveying path 24. The recording sheet may be conveyed by conveying rollers 25 onto a platen 26. The recording head 21 may selectively eject ink onto the recording sheet conveyed over the platen 26. Thus, an image may be recorded onto the recording sheet. The recording sheet conveyed past the platen 26 may be output by output rollers 22 onto an output tray 16 positioned on the most downstream side of the conveying path 24 in a sheet conveying direction.

Figure 2:
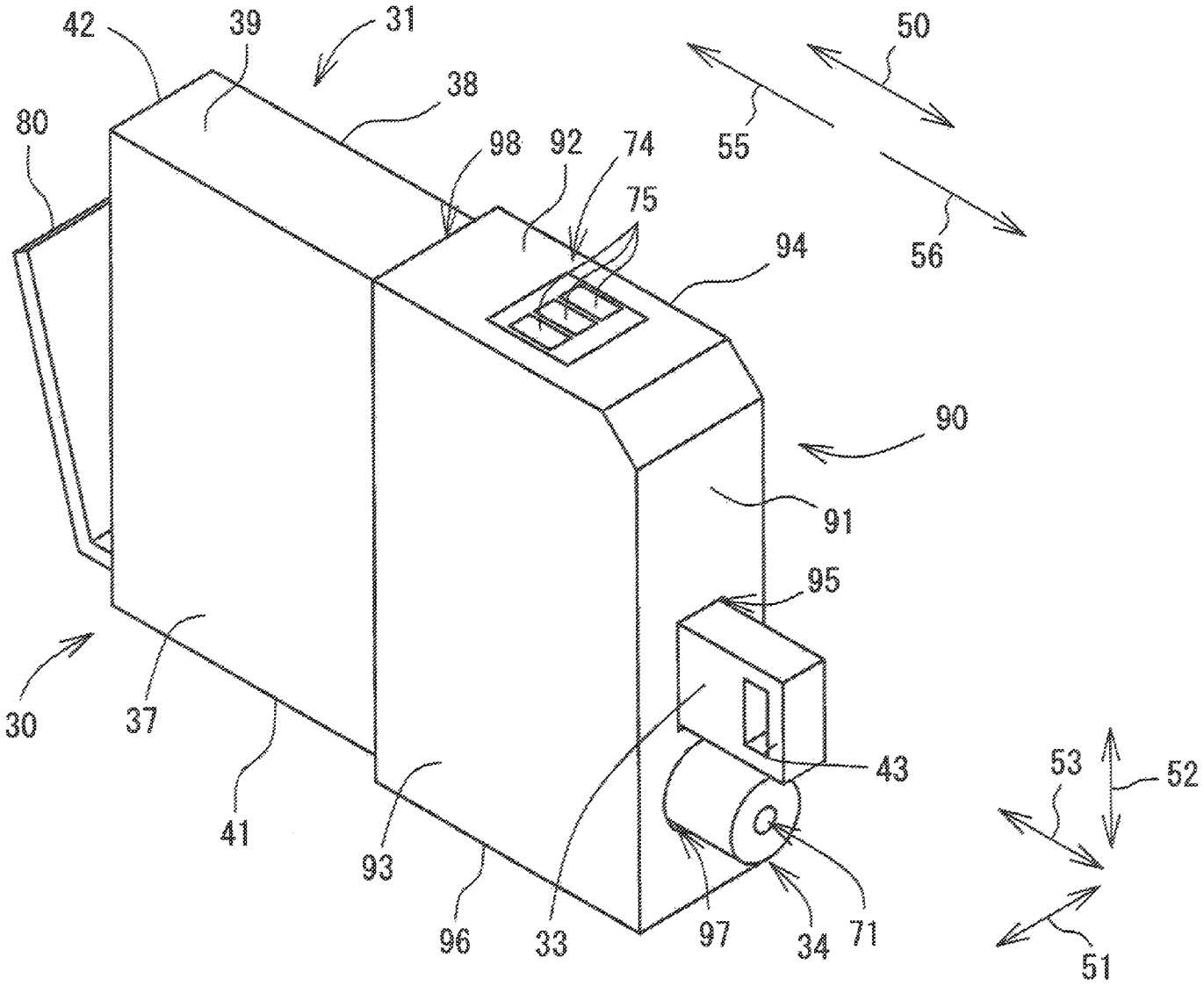
FIG. 2 is a perspective of an ink cartridge to which an adaptor is mounted according to an embodiment of the present invention.
Figure 3:
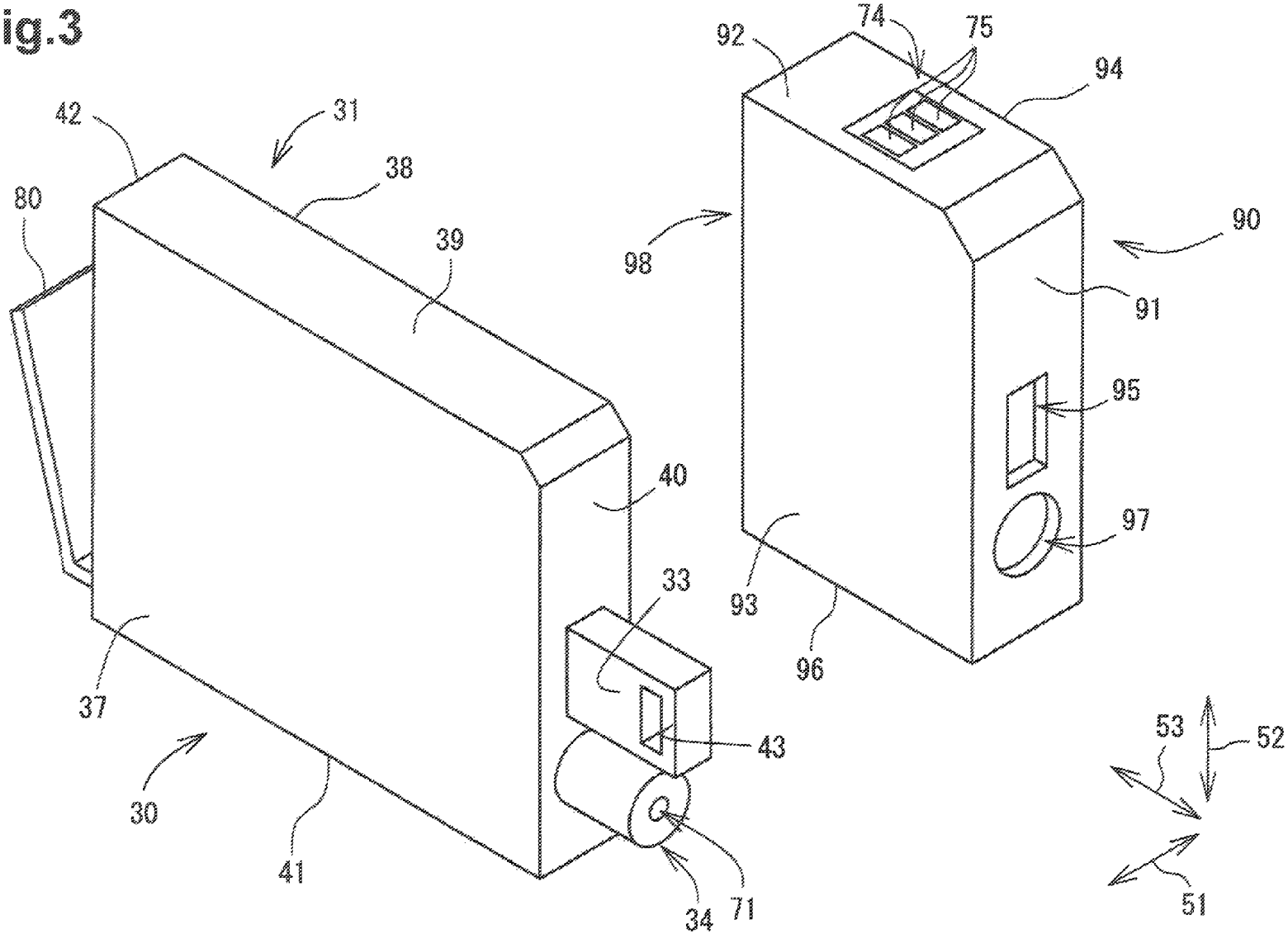
FIG. 3 is a perspective view of the ink cartridge of FIG. 2 with the adaptor removed, according to an embodiment of the present invention.
Figure 4:
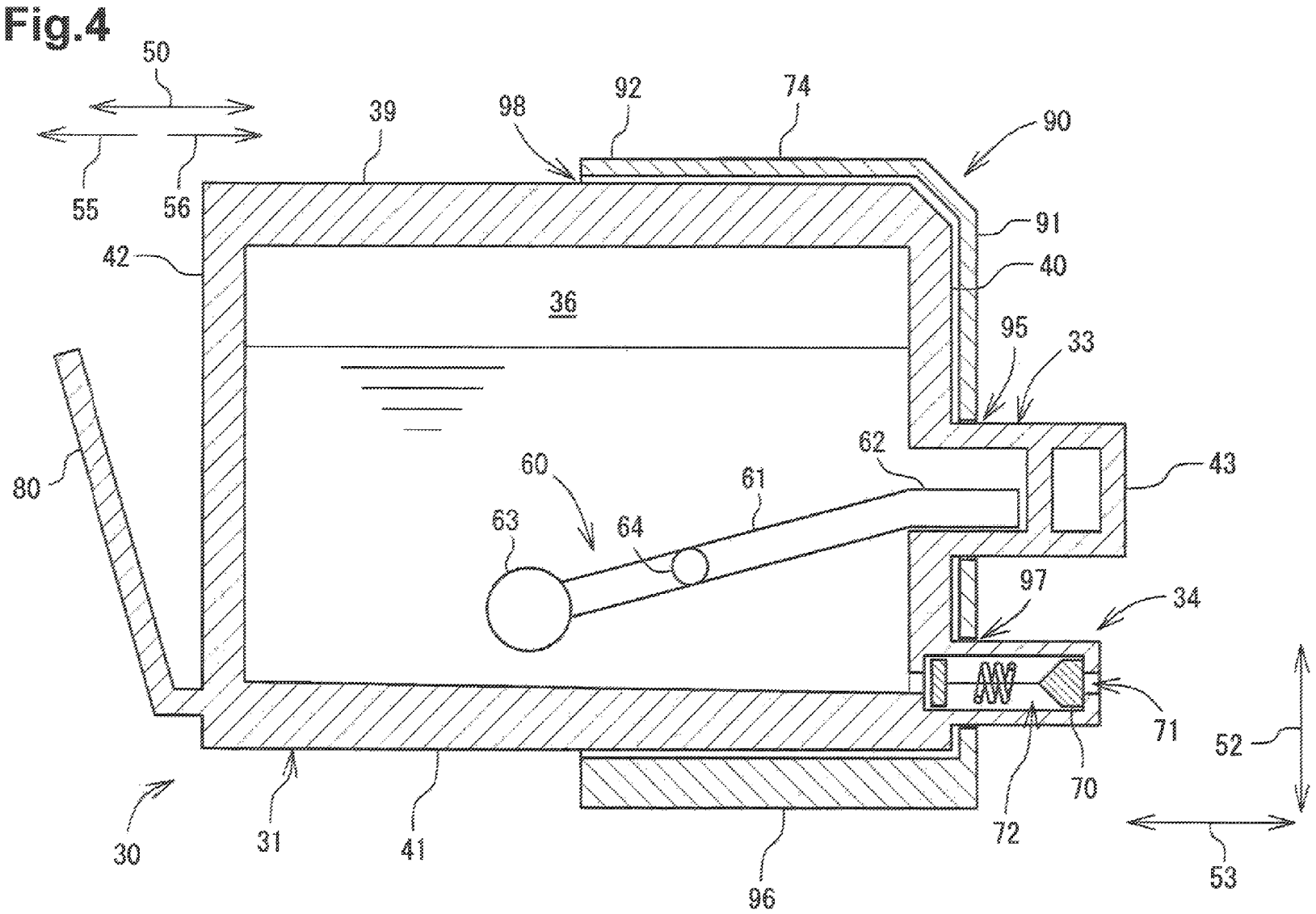
FIG. 4 is a cross-sectional view of an ink cartridge and an adaptor according to an embodiment of the present invention.

Referring to FIGS. 2-4, the ink cartridge 30 may be inserted into and removed from the cartridge mounting portion 110 in an insertion/removal direction 50, e.g., a horizontal direction. More specifically, the ink cartridge 30 may be inserted into the cartridge mounting portion 110 in an insertion direction 56 and removed from the cartridge mounting portion 110 in a removal direction 55.

The ink cartridge 30 may comprise a container configured to store ink therein. The ink cartridge 30 may comprise a main body 31 comprising an ink chamber 36 within the main body 31. The ink chamber 36 may be configured to store ink therein. In another embodiment, the ink chamber 36 may be defined by a member other than the main body 31.

The main body 31 may have a depth in a depth direction 53, parallel to the insertion/removal direction 50, a width in a width direction 51, and a height in a height direction 52. The width may be less than each of the height and the depth. The height direction 52, e.g., a vertical direction, may be parallel to a direction of gravity.

The main body 31 may comprise a front wall 40, and a rear wall 42 positioned opposite the front wall 40 in the insertion/removal direction 50. When the ink cartridge 30 is inserted into the cartridge mounting portion 110, the front wall 40 may face forward in the insertion direction 56 of the ink cartridge 30 and the rear wall 42 may face rearward in the insertion direction 56. The ink cartridge 30 also may comprise a upper wall 39 facing upper direction and a bottom wall 41 opposite the upper wall 39 in the height direction 52. The upper wall 39 may be connected to the upper end of the front wall 40 at one end and connected to the upper end of the rear wall 42 at the other end. The bottom wall 41 may be connected to the lower end of the front wall 40 at one end and connected to the lower end of the rear wall 42 at the other end. The ink cartridge 30 may further comprise side walls 37 and 38 that may be separated from each other in the width direction 51 and may connect to ends of the upper wall 39, the front wall 40, the lower wall 41, and the rear wall 42.

The ink cartridge 30 may be inserted into and removed from the cartridge mounting portion 110 in the insertion/removal direction 50, in an orientation depicted in FIG. 2, e.g., with the upper wall 39 thereof facing upward and the bottom wall 41 thereof facing downward. In another embodiment, the ink cartridge 30 may be inserted into and removed from the cartridge mounting portion 110 in the direction of gravity or a direction perpendicular to the horizontal direction and the direction of gravity. For example, when the ink cartridge 30 is inserted into and removed from the cartridge mounting portion 110 in the direction of gravity, the front wall 40 of the ink cartridge 30 may face downward. The adaptor 90 may be configured to attach to the ink cartridge 30 on the side of the front wall 40.

Figure 5:
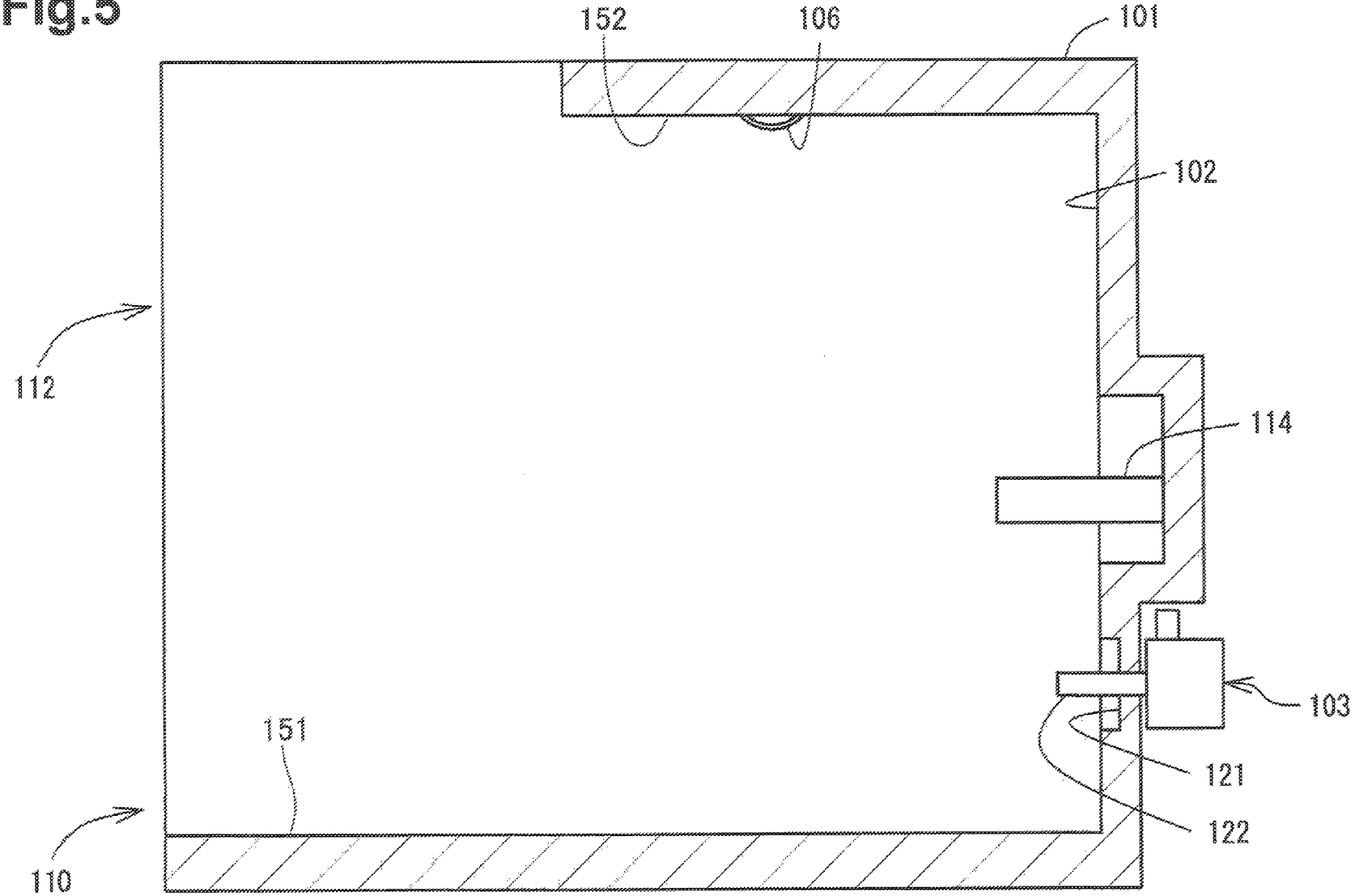
FIG. 5 is a cross-sectional view of a cartridge mounting portion according to an embodiment of the present invention.

Referring to FIGS. 2-4, the main body 31 may comprise a residual amount detection portion 33 positioned at a middle portion of the front wall 40 of the main body 31 in the height direction 52. The residual amount detection portion 33 may have an open-box shape with an open end. The residual amount detection portion 33 may be configured to be in liquid communication with ink chamber 36 via the open end. The residual amount detection portion 33 may comprise a left wall and a right wall each comprising translucent resin configured to allow light to pass through. The light, e.g., infrared light, may be emitted in a direction perpendicular to the insertion/removal direction 50, e.g., the width direction 51, from an optical sensor 114, as shown in FIG. 5, that may be positioned at the cartridge mounting portion 110. The residual amount detection portion 33 may further comprise a translucent front, upper and bottom walls defining the residual amount detection portion 33 with the side walls thereof. The walls of the residual amount detection portion 33 may be configured to allow light to pass therethrough in the width direction 51. The residual amount detection portion 33 may be exposed via an opening 95 formed in the adaptor 90 when the adaptor 90 attaches to the ink cartridge 30. In another embodiment, the residual amount detection portion 33 may comprise a reflecting member configured to reflect light incident on a translucent resin material at an angle larger than a critical angle. In another embodiment, the light emitted from the optical sensor 114 may be visible light. A space between the pair of the left and right walls of the residual amount detection portion 33 may be hollow to store ink therein.

Referring to FIG. 4, the residual amount detection portion 33 may comprise a sensor arm 60 that may comprise a plate-shaped arm body 61, a plate-shaped indicator portion 62 disposed at an end of the arm body 61, and a float portion 63 disposed at the other end of the arm body 61. The indicator 62 may be facing on the width direction 51. The indicator portion 62 may be located between the left and right walls of the residual amount detection portion 33. The sensor arm 60 may be pivotally supported by a support shaft 64 extending in the width direction 51 in the ink chamber 36. The sensor arm 60 may be configured to pivot in accordance with an amount of ink in the ink chamber 36. The indicator portion 62 may move between a lower position in which the indicator portion 62 is located at the lower position in the direction of gravity in the residual amount detection portion 33 and an upper position in which the indicator portion 62 is located at the upper position in the direction of gravity in the residual amount detection portion 33, according to the residual amount of ink in the ink chamber 36. More specifically, when an amount of ink in the ink chamber 36 is equal to or greater than a predetermined amount, the indicator portion 62 may be placed in the lower position. When ink is used and an amount of ink in the ink chamber 36 is less than the predetermined amount, the indicator portion 62 may be placed in the upper position. FIG. 4 may depict a state where a predetermined amount or more of ink may be present, and the indicator portion 62 is placed in the lower position. The indicator portion 62 may correspond to the second light attenuating portion.

When the ink cartridge 30 is mounted to the cartridge mounting portion 110, the residual amount detection portion 33 may allow a predetermined amount or more of the infrared light emitted from the optical sensor 114 to pass through in a direction perpendicular to the insertion/removal direction 50, e.g., the width direction 51, or may block or attenuate the light to an amount less than the predetermined amount, depending on the amount of ink stored in ink chamber 36. When the indicator portion 62 is in the upper position, the residual amount detection portion 33 may allow the light to pass therethrough. When the indicator portion 62 is in the lower position, the residual amount detection portion 33 may block or attenuate the infrared light. Based on whether the residual amount detection portion 33 allows the light, therethrough or blocks or attenuates the light, it may be determined whether the residual ink amount in ink chamber 36 is less than a predetermined amount.

Referring to FIGS. 2-4, the main body 31 may further comprise a light attenuating portion 43 disposed at a front side of the residual amount detection portion 33 of the main body 31 in the insertion direction 56. The light attenuating portion 43 and the residual amount detection portion 33 may be disposed with a space therebetween in the depth direction 53. The light attenuating portion 43 may have a depth in the depth direction 53 and be elongated in the height direction 52. The height and width of the light attenuating portion 43 in the height direction 52 and the width direction 51, respectively, may be approximately the same as the height and the width of the residual amount detection portion 33 in the height direction 52 and the width direction 51, respectively. The depth of the light attenuating portion 43 in the depth direction 53 may be shorter than a depth of the residual amount detection portion 33 in the depth direction 53. The light attenuating portion 43 may block or attenuate the infrared light emitted from the optical sensor 114, as depicted in FIG. 5, in a direction perpendicular to the insertion/removal direction 50, e.g., the width direction 51. The light attenuating portion 43 may be exposed together with the residual amount detection portion 33 via the opening 95 formed in the adaptor 90 when the adaptor 90 attaches to the ink cartridge 30. The light attenuating portion 43 may correspond to a first light attenuating portion. The attenuating portion and the indicator 62 may correspond to a light attenuating portion. The residual amount detection portion 33 and light attenuating portion 43 may correspond to an ink detecting portion.

The space or distance between the light attenuating portion 43 and the residual amount detection portion 33 in the depth direction 53 may differ, for example, according to initial amounts of ink stored in the ink chambers 36 of the ink cartridges 30. For example, the depth of the light attenuating portion 43 in the depth direction 53 may be increased to reduce the distance between the light attenuating portion 43 and the residual amount detection portion 33. With the difference of the distance between the light attenuating portion 43 and the residual amount detection portion 33, the time in which the infrared light emitted from the optical sensor 114 may pass the space or distance between the residual amount detection portion 33 and the light attenuating portion 43 when the ink cartridge 30 is mounted to the cartridge mounting portion 110, may vary according the initial amounts of ink stored in the ink chambers 36 of the ink cartridges 30.

The main body 31 may comprise an ink outlet portion 34 positioned at the front wall 40 of the main body 31 below the residual amount detection portion 33. The ink outlet portion 34 is protruded from the exterior of the surface of the front wall 40 in the depth direction 53. The ink outlet portion 34 may have a cylindrical shape and may protrude outward from the front wall 40 in the insertion/removal direction 50. The projecting end of the ink outlet portion 34 may be provided with an ink outlet port 71. The ink outlet port 71 of the ink outlet portion 34 may be exposed via an opening 97 of the adaptor 90. The exterior surface of the front wall 40 may correspond to the first surface. The opening 95 is formed in a center area in upper direction of the front wall 91, and the opening 97 is formed upstream from the opening 95 upper direction.

The ink outlet portion 34 may have an ink flow path 72 formed therein. The ink flow path 72 may extend in the insertion/removal direction 50 from the ink outlet port 71 to the ink chamber 36 via an internal space of the ink outlet portion 34. An ink outlet valve 70 may be disposed in the ink channel 72 and configured to selectively open and close the ink outlet port 71. When the ink cartridge 30 is mounted to the cartridge mounting portion 110, a hollow tube 122, as depicted in FIG. 5, provided in the cartridge mounting portion 110 may enter the ink outlet port 71, to open the ink outlet valve 70. Thus, ink may be directed from the ink chamber 36 into the hollow tube 122, through the ink channel 72.

In another embodiment, the ink outlet port 71 may be sealed with a film. When the ink cartridge 30 is mounted to the cartridge mounting portion 110, the hollow tube 122 may penetrate the film to open the ink outlet port 71. In another embodiment, the main body 31 may have an air communication opening to release pressure in the ink chamber 36, which may be maintained at negative pressure, into the atmospheric pressure.

A handle 80 may be provided on the rear wall 41 of the main body 31. The handle 80 may have a plate shape extending slantingly rearward from a portion near the lower end of the rear wall 41. The shape and position of the handle 80 may not be limited to the above shape and position, but may have any shape and position that may make the main body 31 easily removed from the cartridge mounting portion 110 when a user replaces the ink cartridge 30.

The adaptor 90 may have a relatively thin open box-shape with an open end. The adaptor 90 may be configured to cover at least a portion of an outer surface of the main body 31 comprising the front wall 40, the side walls 37 and 38, the upper wall 39, and the bottom wall 42. The adaptor 90 may have such a width and height to cover a whole area of the front wall 40 of the main body 31 and such a depth to cover a portion of the side walls 37, 38, the upper wall 39, and the bottom wall 42. In other words, the adaptor 90 may have a box shape having a width and height slightly wider and higher than those of the main body 31 and a depth shorter than the depth of the main body 31.

The adaptor 90 may comprise a front wall 91, an upper wall 92 facing on the height direction, side walls 93, 94, and a bottom wall 96 opposite the front wall 40, the upper wall 39, the side walls 37 and 38, and the bottom wall 42 of the main body 31, respectively, when the adaptor 90 attaches to the ink cartridge 30. The front wall 91 may be perpendicular to the upper wall 39 The adaptor 90 may have an opening 98 opposite the front wall 91 in the depth direction 53. The main body 31 may be inserted into and removed from the opening 98. An outer surface of the upper wall 92 may correspond to a second surface. An outer surface of the front wall 91 may correspond to a third surface. An outer surface of each of the side walls 93, 94 may correspond to a fourth surface.

The adaptor 90 may be inserted into and removed from the cartridge mounting portion 110 in the insertion/removal direction 50, in the horizontal direction, in an orientation depicted in FIG. 2, e.g., with the upper wall 92 thereof facing upward and the bottom wall 96 thereof facing downward.

The adaptor 90 may have the opening 95 formed at generally a middle portion of the front wall 91 in the height direction 52 through the front wall 91 in the depth direction 53. When the main body 31 of the ink cartridge 30 is inserted into the adaptor 90, the residual amount detection portion 33 and the light attenuating portion 43 of the main body 31 may be exposed via the opening 95. The position, size and shape of the opening 95 may be formed in correspondence with those of the residual amount detection portion 33 and the light attenuating portion 43.

The adaptor 90 also may have the opening 97 formed at a lower portion of the front wall 91 in the height direction 52 through the front wall 91 in the depth direction 53. The opening 95 may be disposed downstream from the opening 97 in the height direction 52. When the main body 31 of the ink cartridge 30 is inserted into the adaptor 90, the ink outlet portion 34 of the main body 31 may be exposed via the opening 97. The position, size and shape of the opening 97 may be formed in correspondence with those of the ink outlet portion 34.

An IC substrate 74, may be disposed on the upper wall 92 of the adaptor 90. The IC substrate 74 may be electrically connected with a contact 106, as depicted in FIG. 5, while the adaptor 90 is being mounted to the cartridge mounting portion 110 and when the adaptor 90 is mounted to the cartridge mounting portion 110.

The IC substrate 74 may comprise an integrated circuit ("IC") and electrodes 75 comprising a HOT electrode, a GND electrode, and a signal electrode. The IC may be a semiconductor integrated circuit and configured to store data of information about the ink cartridge 30, e.g., ink color and a manufacturer, that may not have to be renewed or updated when the ink cartridge 30 is replaced. The data stored in the IC may be read out by the printer 10.

Figure 7:
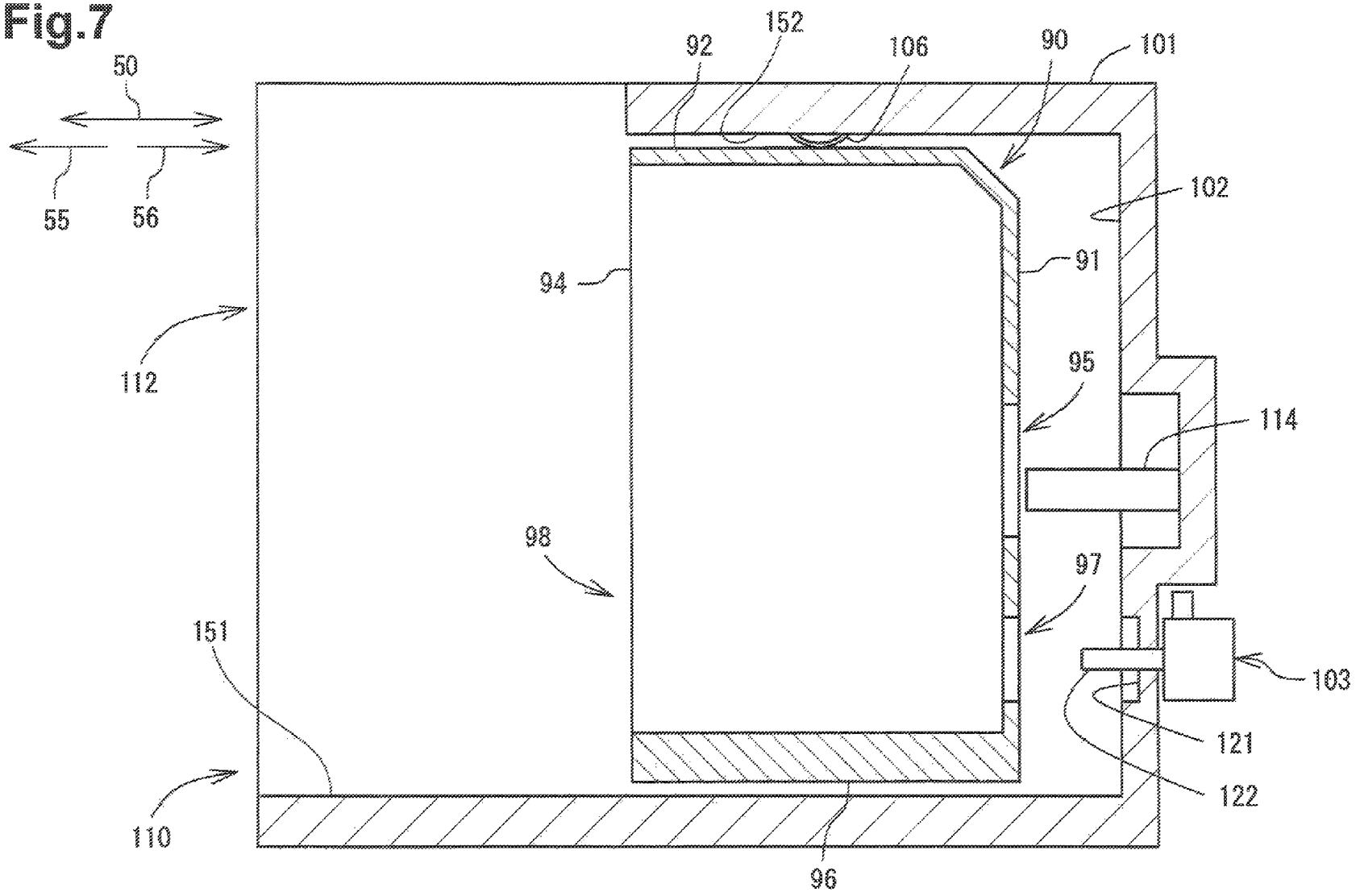
FIG. 7 is a cross-sectional view of the adaptor FIG. 4 mounted on the cartridge mounting portion. of FIG. 5 according to an embodiment of the present invention.

The electrode 75 may be electrically connected with the IC. The HOT electrode, the GND electrode, and the signal electrode may be elongated in the depth direction 53 and may be separated from each other in the width direction 51. The electrode 75 may be exposed on an upper surface of IC substrate 74 so as to allow electrical access. In other words, the electrode 75 may be exposed to be accessible from an upper side of the adaptor 90 when the adaptor 90 is mounted to the cartridge mounting portion 110. Referring to FIG. 7, when the adaptor 90 attaches to the cartridge mounting portion 110, the bottom wall 96 of the adaptor 90 may contact an bottom inner surface 151 of the cartridge mounting portion 110, and the IC substrate 74 disposed on the upper wall 91 of the adaptor 90 may be electrically connected with the contact 106.

Referring to FIG. 1, the printer 10 may comprise the recording head 21 and the ink supply device 100 configured to supply ink to the recording head 21. The ink supply device 100 may comprise the cartridge mounting portion 110 configured to receive the ink cartridge 30 and the adaptor 90. In FIG. 1, the ink cartridge 30 and the adaptor 90 may be mounted to the cartridge mounting portion 110.

Referring to FIG. 5, the cartridge mounting portion 110 may comprise a case 101 serving as a housing. The case 101 may have the opening 112 on a front side of the printer 10. The ink cartridge 30 and the adaptor 90 may be selectively inserted into and removed from the case 101 via the opening 112. The case 101 may be configured to accommodate a plurality of, e.g., four, the ink cartridges 30 and a plurality of, e.g., four, adaptors 90. Each ink cartridge 30 and the adaptor 90 may correspond to one of a plurality of colors, e.g., cyan, magenta, yellow, and black. FIG. 5 may depict a space of the case 101 in which one ink cartridge 30 and one adaptor 90 may be accommodated.

Referring to FIG. 5, the case 101 may have an end inner surface 102 at a side opposite from the opening 112 in the insertion/removal direction 50, an upper inner surface 152 that may be connected to an upper end of the end inner surface 102 in the height direction 52, and the bottom inner 151 surface at a side opposite from the upper inner surface 152 in the height direction 52. A connecting portion 103 may be disposed at a lower portion of the end inner surface 102 in correspondence with each ink outlet portion 34 of the ink cartridges 30 when the ink cartridges 30 are mounted to the case 101.

Figure 6:
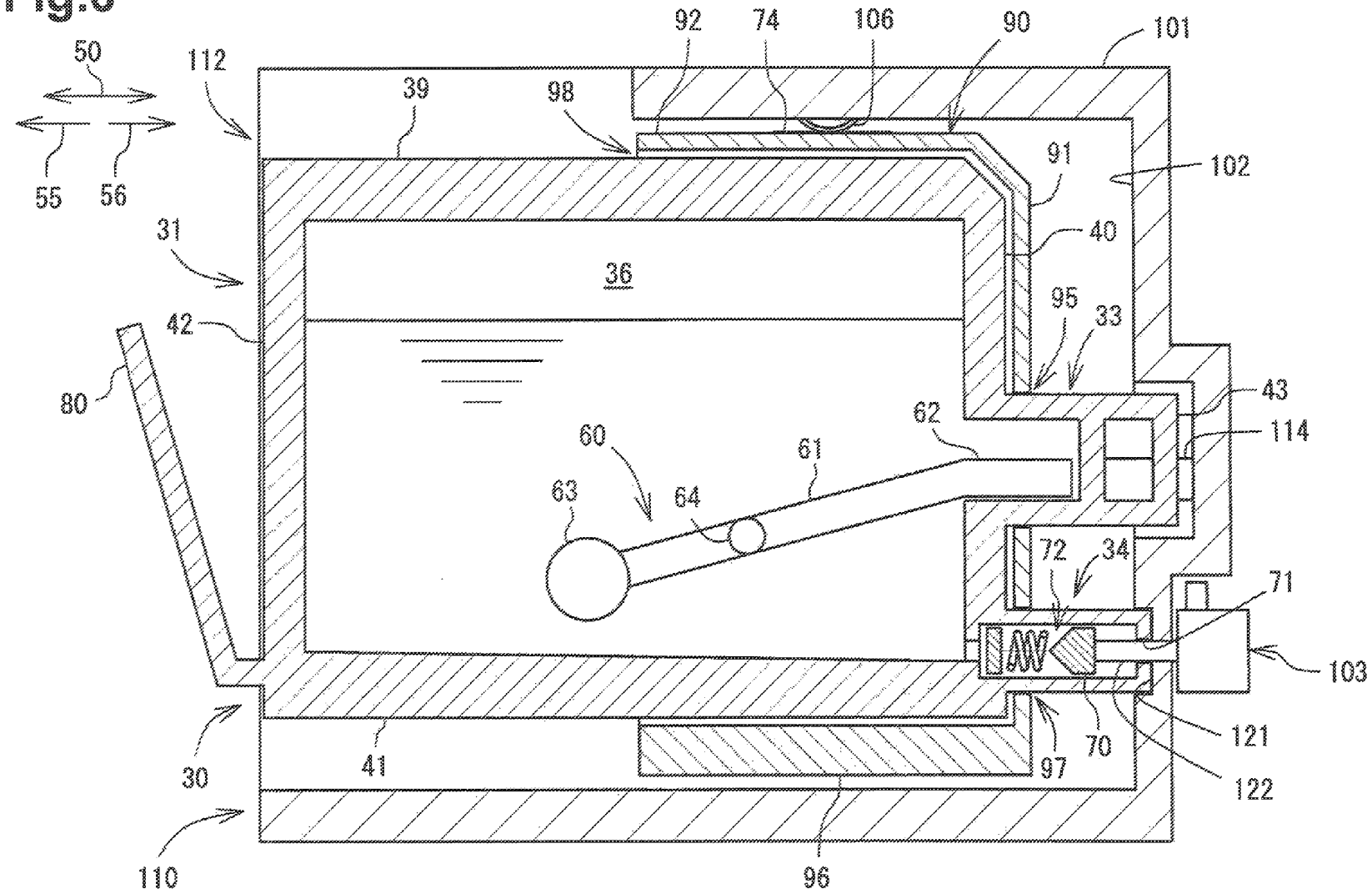
FIG. 6 is a cross-sectional view of the ink cartridge and the adaptor of FIG. 4 mounted on the cartridge mounting portion of FIG. 5 according to an embodiment of the present invention.

The connecting portion 103 may comprise the hollow tube 122 and a holding portion 121. The hollow tube 122 may be formed of resin into a tubular shape. An end of the hollow tube 122 may have an ink introduction port. The hollow tube 122 may be connected to the ink tube 20 at an outer surface opposite from the end inner surface 102 of the case 101. Each ink tube 20 extending from each hollow tube 122 to the outer surface opposite from the end inner surface 102 may be connected to the recording head 21 of the printer 10 so as to circulate the ink. The holding portion 121 may be formed in a cylindrical shape. The hollow tube 122 may be disposed at a middle portion of the holding portion 121. Referring to FIG. 6, when the ink cartridge 30 is mounted to the cartridge mounting portion 110, the ink outlet portion 34 may be inserted into the cylindrical portion of the holding portion 121. The outer peripheral surface of the ink outlet portion 34 may contact the inner peripheral surface of the cylindrical portion of the holding portion 121. The ink outlet portion 34 may be inserted into the holding portion 121 with a predetermined gap therebetween. When the ink outlet portion 34 is inserted into the holding portion 121, the hollow tube 122 may be inserted into the ink outlet port 71 of the ink outlet portion 34. Accordingly, the ink stored in the ink chamber 36 may flow outward. Ink flowing outward from the ink chamber 36 may flow into the hollow tube 122 via the ink introduction port.

Referring to FIG. 5, an optical sensor 114 may be disposed at the end inner surface 102 of the case 101 above the connecting portion 103 in the direction of gravity. The optical sensor 114 may comprise a light-emitting element, e.g., a light-emitting diode (LED), and a light-receiving element, e.g., a phototransistor. Each of the light-emitting element and the light-receiving element may be surrounded by a housing. The external shape of the optical sensor 114 formed by the housing may be a horseshoe shape. The light-emitting element and the light-receiving element may be disposed to face each other with a predetermined distance therebetween in the horseshoe-shaped housing in the horizontal direction perpendicular to the insertion/removal direction 50, e.g., width direction 51. The light-emitting element may emit light through the housing in one direction, e.g., a horizontal direction perpendicular to the insertion/removal direction 50, e.g., width direction 51. The light-receiving element may receive the infrared light emitted from the light-emitting element toward the housing in one direction. The residual amount detection portion 33 and the light attenuating portion 43 of the ink cartridge 30 may enter a space between the light-emitting element and the light-receiving element. When the residual amount detection portion 33 or the light attenuating portion 43 enters the optical path of the optical sensor 114, the optical sensor 114 may detect the light transmission amount changed due to the residual amount detection portion 33 or the light attenuating portion 43.

Referring to FIG. 5, the case 101 may comprise, for example, three, contacts 106 disposed on the upper inner surface 152 of the case 101 at a position between the end inner surface 102 and the opening 112. The contacts 106 may be separated from each other in the width direction 51 perpendicular to the insertion/removal direction 50. The contacts 106 also may be disposed so as to correspond to the HOT electrode, the GND electrode, and the signal electrode on the IC substrate 74 of the ink cartridge 30. Each contact 106 may comprise a material having an electrical continuity and elasticity. Each contact 106 may be configured to elastically deform in an upward direction in the height direction 52.

Each contact 106 may be electrically connected to a controller via an electric circuit. The controller may comprise, for example, a central-processing unit ("CPU"), a read-only memory ("ROM"), and a random-access memory ("RAM") and may be configured as a control device of the printer 10. The contact 106 may be used to apply voltage Vc to the HOT electrode by establishing electrical connection with the HOT electrode. Another contact 106 may be used to allow the GND electrode to establish a ground by establishing electrical connection with the GND electrode. The contacts 106 may be used to supply power to the IC by establishing electrical connection with the HOT electrode and the GND electrode. The other contact 106 may be used to access data stored in the IC by establishing electrical connection with the signal electrode.

For example, when a user first uses the printer 10, no ink cartridges 30 or the adaptor 90 may be mounted on the cartridge mounting portion 110. Before a user first mounts the ink cartridge 30 and the adaptor 90 to the cartridge mounting portion 110, the ink cartridge 30 and the adaptor 90 may not be attached to each other.

Referring to FIG. 6, the adaptor 90 may be attached to the ink cartridge 30 on a side of the front wall 40. The ink cartridge 30 and the adaptor 90 may be inserted into the cartridge mounting portion 110. With the adaptor 90 attached to the ink cartridge 30, the ink outlet portion 34 may be exposed via the opening 97 of the adaptor 90, and the residual amount detection portion 33 and the light attenuating portion 43 may be exposed via the opening 95 of the adaptor 90. When the main body 31 is inserted into the cartridge mounting portion 110, the adaptor 90 may be inserted into the cartridge mounting portion 110 together with the main body 31 while the adaptor 90 contacts the front wall 40 of the main body 31 of the ink cartridge 30. The upper wall 92 may be perpendicular to the front wall 40 of the ink cartridge 30 when the adaptor 90 attaches to the ink cartridge 30. The upper wall 92 is disposed downstream from the ink outlet portion in the height direction 52 direction when the adaptor 90 attaches to the ink cartridge 40. The adaptor 90 covered the front wall 40 of the ink cartridge 30 when the adaptor 90 is attached to the ink cartridge 30. The front wall 90 of the adaptor is configured to cover the front wall 40 when the adaptor 90 is attached to the ink cartridge 30. The residual amount detection portion 33 is disposed downstream from the ink outlet portion 34 in the second direction when the adaptor 90 attaches to the ink cartridge 30.

While the ink cartridge 30 is mounted to the cartridge mounting portion 110, the optical sensor 114 may detect the light attenuating portion 43 at a detecting position where the light-emitting element and the light-receiving element may face each other and the light-receiving element may detect or receive the light. More specifically, the light attenuating portion 43 may block or attenuate the infrared light emitted from the light-emitting element toward the light-receiving element, so that a detection signal output by the optical sensor 114 may vary due to changes in an amount of the light detected or received by the light-receiving element. Accordingly, the controller of the printer 10 may determine that the ink cartridge 30 is mounted to the cartridge mounting portion 110, based on changes in the detection signals output by the optical sensor 114.

When the ink cartridge 30 is further inserted, the light attenuating portion 43 may pass the detecting position of the optical sensor 114 and an area between the light attenuating portion 43 and the residual amount detection portion 33 may reach the detecting position of the optical sensor 114. Accordingly, the detection signal output by the optical sensor 114 may change. Thereafter, the residual amount detection portion 33 may reach the detecting position of the optical sensor 114. Thus, the optical sensor 114 may detect the indicator portion 62 of the sensor arm 60. The detection signal output by the optical sensor 114 may change as the light attenuating portion 43 passes the detecting position and may change again as the indicator portion 62 of the residual amount detection portion 33 reaches the detecting position. The controller may detect respective light attenuating portion 43 and the residual amount detection portion 33, based on changes in the detection signals output by the optical sensor 114. In other words, the controller may detect the mounting of the ink cartridge 30 to the cartridge mounting portion 110, and a residual ink and initial ink amounts in the ink cartridge 30, based on changes in the detection signals output by the optical sensor 114.

FIG. 6, the ink outlet portion 34 exposed outward from the adaptor 90 may contact the holding portion 121, and the hollow tube 122 may enter the ink outlet port 71 of the ink outlet portion 34. As the hollow tube 122 contacts the valve 70 through the ink outlet port 71, and the main body 31 is further moved in the insertion direction 56, the hollow tube 122 may push the valve 70 to move away from the ink outlet port 71. As the ink outlet portion 34 is inserted into the holding portion 121, and the hollow tube 122 is inserted into the ink outlet port 71, the main body 31 of the ink cartridge 30 may be placed in a predetermined portion of the case 101.

When the ink cartridge 30 and the adaptor 90 are mounted to the cartridge mounting portion 110, the position of each of the electrodes 75 of the IC substrate 74 may align the respective contact 106 of the cartridge mounting portion 110 in the height direction 52 when viewed from the depth direction 53. The adaptor 90 may elastically deform the contacts 106 to push up the contacts 106 when the adaptor 90 attaches to the cartridge mounting portion 110. When the adaptor 90 attaches to the cartridge mounting portion 110, the contacts 106 urged downward by an elastic restoring force may electrically contact the IC substrate 74 provided in the adaptor 90, so as to electrically connected with the electrode 75 of the IC substrate 74. Information read from the IC substrate 74 may be used to determine the color of ink stored in the ink cartridge 30 and its manufacturer. The color of ink in stored in the ink cartridge 30 and its manufacturer may be determined based on the information.

The ink cartridge 30 and the adaptor 90 may be positioned in the case 101, for example, with a protrusion disposed in an inner surface of the case 101.

When ink in the ink chamber 36 of the ink cartridge 30 is consumed, the used ink cartridge 30 may be removed from the cartridge mounting portion 110 and a new ink cartridge 30 may be mounted. The ink cartridge 30 with depleted ink may be replaced. For example, when a plurality of, e.g., four, ink cartridges 30 of a plurality of colors, e.g., cyan, magenta, yellow, and black, and the adaptors 90 are mounted to the cartridge mounting portion 110, the four ink cartridges 30 may not be depleted at the same time. Therefore, a user may replace the ink cartridge 30 that is depleted.

When the ink cartridge 30 is removed from the cartridge mounting portion 110, the handle 80 of the main body 31 may be pulled in the removal direction 55. Thus, the ink cartridge 30 may move in the removal direction 55. The ink cartridge 30 may not be engaged with the adaptor 90, so that the ink cartridge 30 may be selectively inserted into and removed from the adaptor 90 through the opening 98. As the handle 80 is pulled in the removal direction 55, the ink cartridge 30 may move relative to the adaptor 90 in the removal direction 55.

As the ink cartridge 30 is moved in the removal direction 55, the ink outlet portion 34 may pass through the opening 97 in the removal direction 55. The residual amount detection portion 33 and the light attenuating portion 43 may move away from the detecting position of the optical sensor 114 in the removal direction 55. As the light attenuating portion 43 moves away from the detecting position of the optical sensor 114, the detection signal output by the optical sensor 114 may change. The controller of the printer 10 may determine that the ink cartridge 30 is removed from the cartridge mounting portion 110, based on changes in the detection signal output by the optical sensor 114.

When the ink cartridge 30 is removed from the cartridge mounting portion 110, the adaptor 90 may remain in the cartridge mounting portion 110, as depicted in FIG. 7, as an urging force received from the contacts 106 may become a resistance force for the adaptor 90 to move in the removal direction 55. The IC substrate 74 may remain electrically connected with the contacts 106. A new ink cartridge 30 may be mounted to the cartridge mounting portion 110. The ink cartridge 30 may move in the insertion direction 56 to the opening 98 of the adaptor 90 in the cartridge mounting portion 110. In the cartridge mounting portion 110, the ink cartridge 30 and the adaptor 90 may be attached to each other.

While the ink cartridge 30 is being inserted into in the cartridge mounting portion 110 to attach the ink cartridge 30 to the adaptor 90, the light attenuating portion 43 and the residual amount detection portion 33 may sequentially pass through the opening 95 of the adaptor 90, and the light attenuating portion 43 may be detected by the optical sensor 114. As the detection signal output by the optical sensor 114 changes, the controller of the printer 10 may determine that the ink cartridge 30 is mounted to the cartridge mounting portion 110.

After the light attenuating portion 43 passes the detecting position of the optical sensor 114, the residual amount detection portion 33 may reach the detecting position of the optical sensor 114. Thus, the optical sensor 114 may detect the indicator portion 62 of the sensor arm 60.

The ink outlet portion 34 passing through the opening 97 of the adaptor 90 may contact the holding portion 121. The hollow tube 122 may be inserted into the ink outlet port 71 of the ink outlet portion 34.

When the printer 10 is first used after purchase, the ink cartridge 30 and the adaptor 90 may be mounted to the cartridge mounting portion 110. If the ink cartridge 30 and the adaptor 90 are mistakenly mounted to a portion of the cartridge mounting portion 110 that may not correspond to the color of ink stored in the ink cartridge 30, the controller may determine that the ink cartridge 30 is mounted to a wrong portion of the cartridge mounting portion 110, based on the color information stored in the IC substrate 74. When the ink cartridge 30 is replaced, the adaptor 90 may remain in the cartridge mounting portion 110. As the residual amount detection portion 33 and the light attenuating portion 43 of a new ink cartridge is detected, information about a residual amount of ink and an initial amount of ink that may be obtained from the previously-mounted ink cartridge 30 and the mounting of the new ink cartridge 30 may be renewed or updated. The IC substrate 74 of the adaptor 90 may not repeatedly slide with the contacts 106, so that wear of the contacts 106 may be reduced.

As described above, the residual amount detection portion 33 may comprise the sensor arm 60. In another embodiment, the residual amount detection portion 33 may not comprise the sensor arm 60. The light-emitting element and the light-receiving element of the optical sensor 114 may oppose in a horizontal direction perpendicular to the insertion/removal direction 50, i.e., the width direction 51. The light emitted from the light-emitting element may pass in the horizontal direction perpendicular to the insertion/removal direction 50 and be received by the light-receiving element. When there is ink in the residual amount detection portion 33, the residual amount detection portion 33 may block or attenuate the light emitted from the light-emitting element. When there is no ink in the residual amount detection portion 33, the residual amount detection portion 33 may pass the light emitted from the light-emitting element by a predetermined amount or more. In another embodiment, the residual amount detection portion 33 may comprise a flexible film. When there is ink in the residual amount detection portion 33, the film may be expanded. As the film contacts a pivotable lever, the lever may be placed at a position to block the light. When there is no ink in the residual amount detection portion 33, the film may be contracted. The lever may pivotally move up or down so as to be located at a position where the light is not blocked. In another embodiment, the light emitted from the light-emitting element may be reflected on or in the residual amount detection portion 33 so as not to reach the light-receiving element when there is ink in the residual amount detection portion 33, and may be reflected on or in the residual amount detection portion 33 so as to be received by the light-receiving element when there is no ink in the residual amount detection portion 33.

As described above, the light attenuating portion 43 may be disposed in front of the residual amount detection portion 33 in the insertion direction 56, with a space therebetween. In another embodiment, a light attenuating portion 44 may be disposed in contact with the residual amount detection portion 33, as depicted in FIGS. 8A-8D.

Figure 8A:
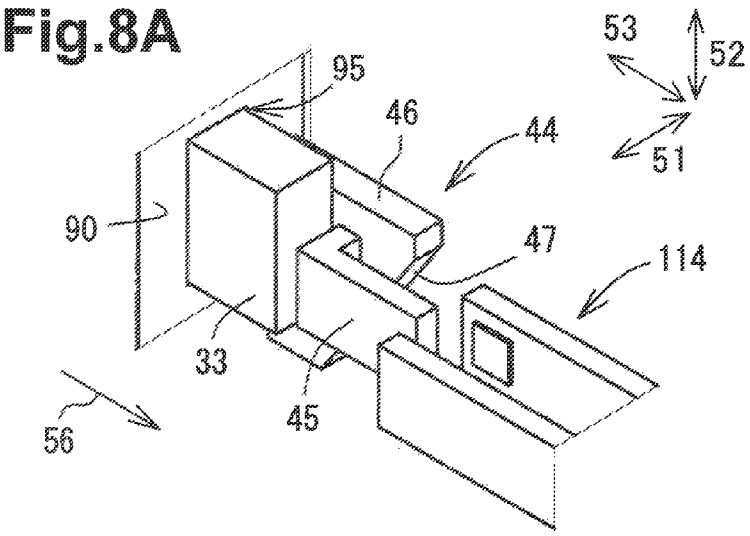
FIG. 8A is a perspective view depicting a mounting operation of a light portion of an ink cartridge according to an embodiment of the present invention.
Figure 8B:
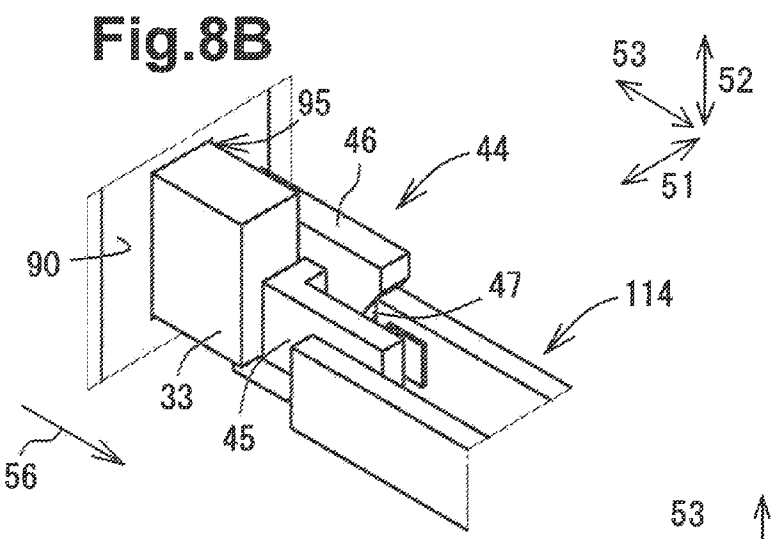
FIG. 8B is another perspective view depicting the mounting operation of a light attenuating portion of an ink cartridge according to an embodiment of the present invention.
Figure 8C:
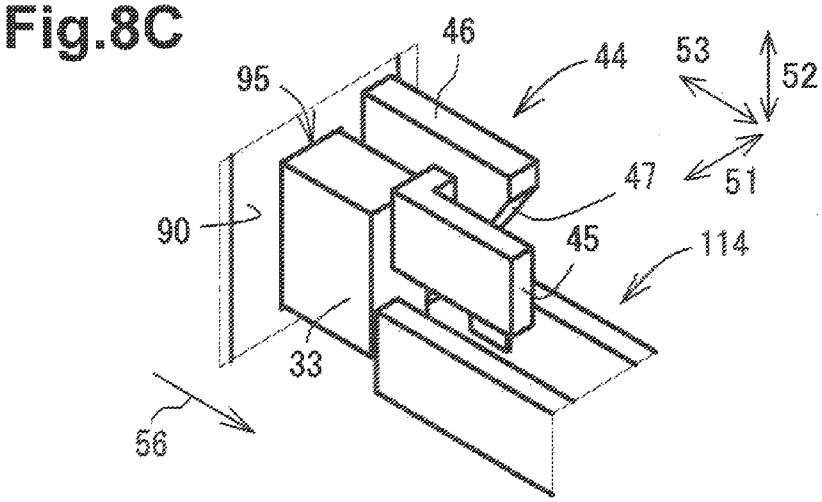
FIG. 8C is still another perspective view depicting a mounting operation of a light attenuating portion of an ink cartridge according to an embodiment of the present invention.
Figure 8D:
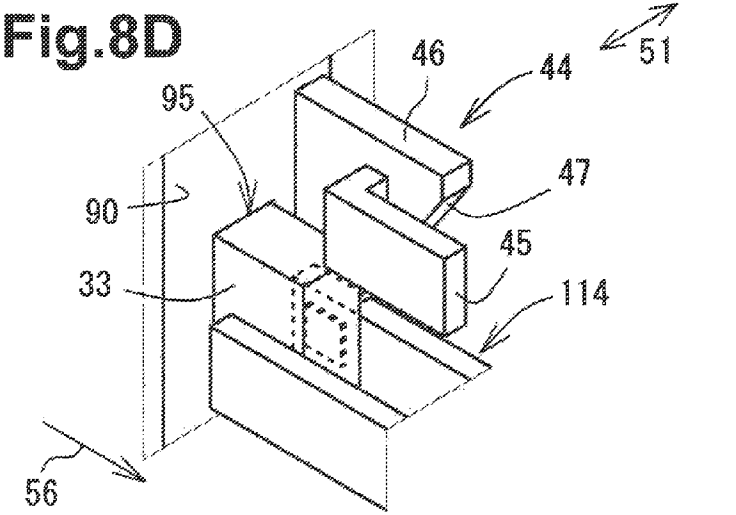
FIG. 8D is yet another perspective view depicting a mounting operation of a light attenuating portion of an ink cartridge according to an embodiment of the present invention.

Referring to FIGS. 8A-8D, the light attenuating portion 44 may be disposed in front of and in contact with the residual amount detection portion 33 of the main body 31 in the insertion direction 56. The light attenuating portion 44 may comprise a light attenuating plate 45 configured to enter the detecting position of the optical sensor 114, and a guide plate 46 configured to contact the optical sensor 114. The light attenuating plate 45 and the guide plate 46 may be connected to each other to face each other in the width direction 51. A front portion of the guide plate 46 in the insertion direction 56 may comprise a guide surface 47. The guide surface 47 may extend in the width direction 51, and may face downward in the height direction 52 while slanting rearward in the insertion direction 56. The light attenuating plate 45 and the guide plate 46 may be configured to slide in the height direction 52. When the light attenuating plate 45 and the guide plate 46 are placed at a lower position in the height direction 52, as depicted in FIGS. 8A and 8B, the light attenuating plate 45 may be allowed to enter the detecting position of the optical sensor 114 and the guide surface 47 of the guide plate 46 may contact the optical sensor 114 when the light attenuating plate 45 is positioned at the detecting position of the optical sensor 114. When the light attenuating plate 45 and the guide plate 46 are placed at a higher position in the height direction 52, as depicted in FIGS. 8C and 8D, the light attenuating plate 45 may be positioned above the detecting position of the optical sensor 114.

Referring to FIGS. 8A and 8B, while the ink cartridge 30 is being mounted to the cartridge mounting portion 110, the light attenuating plate 45 of the light attenuating portion 44 may enter the detecting position of the optical sensor 114 and may be detected. Referring to FIG. 8C, as the ink cartridge 30 is further moved in the insertion direction 56, the light attenuating plate 45 and the guide plate 46 may move upward in the height direction 52 while being guided by the guide surface 47 contacting the optical sensor 114. The light attenuating plate 45 may move away from the detecting position of the optical sensor 114. Accordingly, the detection signal output by the optical sensor 114 may change. When the light attenuating plate 45 moves away from the detecting position of the optical sensor 114, the residual amount detection portion 33 may not yet reach the detecting position of the optical sensor 114. Referring to FIG. 8D, as the ink cartridge 30 further moves in the insertion direction 56, the residual amount detection portion 33 may reach the detecting position of the optical sensor 114.

As the light attenuating portion 44 enters the detecting position of the optical sensor 114 and then moves away from the detecting position, the detection signal output by the optical sensor 114 may change, similar to the above-described embodiment. Thereafter, the residual amount detection portion 33 may reach the detecting position of the optical sensor 114, the controller may determine the light attenuating portion 44 and the residual amount detection portion 33, based on changes in the detection signals output by the optical sensor 114.

As described above, the IC substrate 74 may be fixed on the upper wall 92 of the adaptor 90. In another embodiment, the IC substrate 74 may be supported on a support plate configured to slide to the upper wall 92 of the adaptor 90 in the height direction 52. When the ink cartridge 30 is mounted to the adaptor 90, the upper wall 39 of the ink cartridge 30 may raise and support the support plate. Thus, the IC substrate 74 may be raised to a height where the IC substrate 74 may be electrically connected with the contacts 106. When the ink cartridge 30 is removed from the adaptor 90, the support plate may be placed at a position lower than the upper wall 92, so that the IC substrate 74 may separate from the contacts 106. In association with the insertion or removal of the adaptor 90 into or from the ink cartridge 30, the IC substrate 74 may be electrically connected with or disconnected from the contacts 106.

Figure 9:
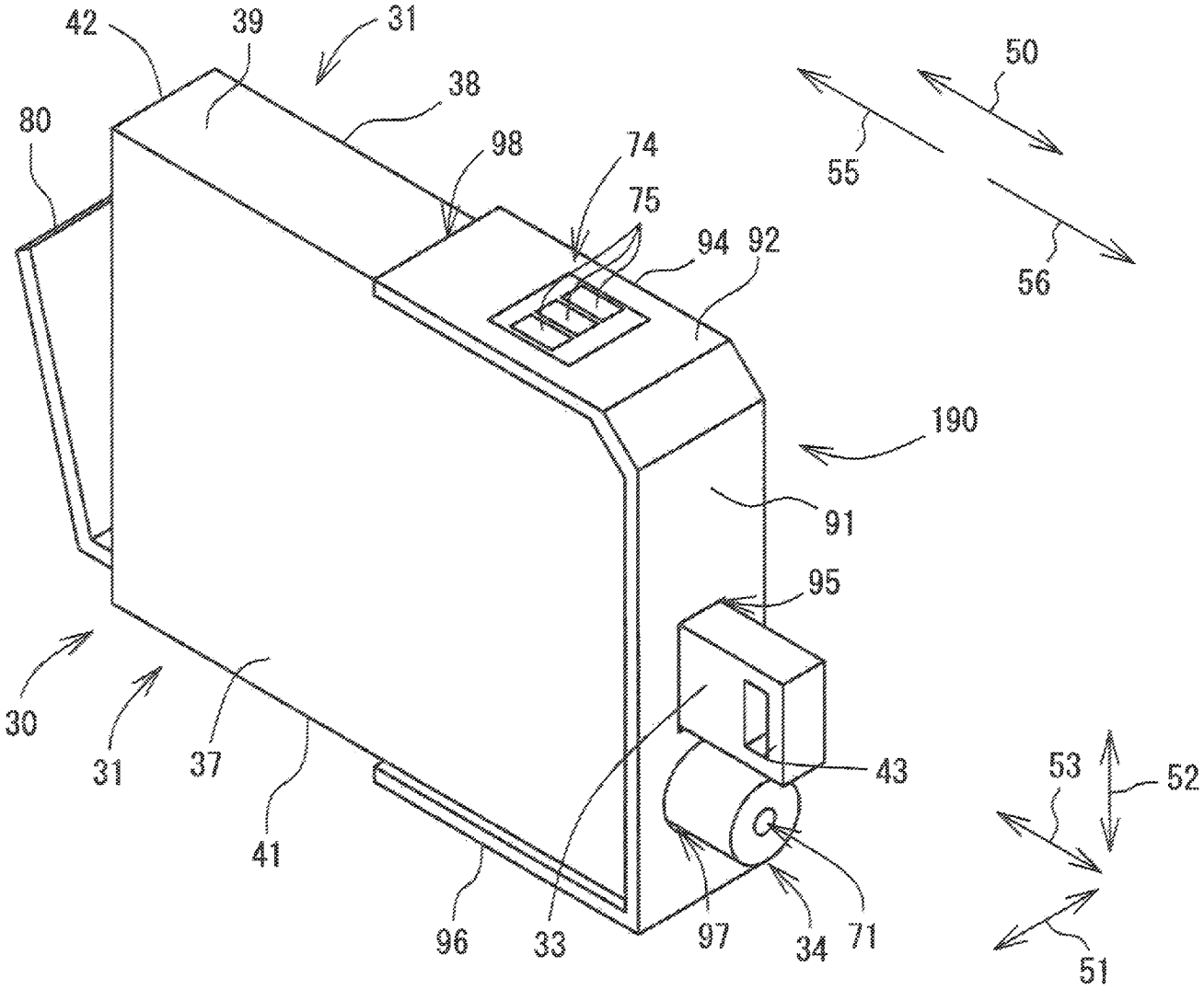
FIG. 9 is a perspective view of an ink cartridge and an adaptor according to another embodiment of the present invention.

As described above, the adaptor 90 may comprise the front wall 91, the upper wall 92, the side walls 93, 94, and the bottom wall 96. In another embodiment, any of walls 91, 92, 93, 94, and 96 may be omitted. For example, referring to FIG. 9, an adaptor 190 may not comprise the side wall 93. Further, both side walls 93 and 94 or the bottom wall 96 may be omitted. The opening 98 of the adaptor 90 through which the ink cartridge 30 is mounted to the adaptor 90 may not have to be defined by four walls but may be defined by, for example, two or three walls.

As described above, when the ink cartridge 30 is mounted to the adaptor 90, a portion of the main body 31 on the side of the rear wall 41 may protrude from the opening 98 of the adaptor 90. In another embodiment, the front wall 40, the upper wall 39, the bottom wall 41, side walls 37 and 38 of the main body 31 of the ink cartridge 30 may be completely covered by the adaptor 90.

As described above, the IC substrate 74 may be disposed on the upper wall 92 of the adaptor 90. In another embodiment, the IC substrate 74 may be disposed on the front wall 91, the side wall 93 and 94, or the bottom wall 96, other than the upper wall 92. As described above, when the IC substrate 74 is disposed on the upper wall 92, the insertion direction 56 in which the adaptor 90 may be inserted into the case 101 of the cartridge mounting portion 110, the width direction 51 in which infrared light from the optical sensor 114 may pass, and the height direction 52 in which the contacts 106 may access or make contact with the IC substrate 74 may be perpendicular to each other. Consequently, deviation of the positioning in one direction may not influence the positioning in other directions.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An adaptor configured to attach with an ink cartridge in an attached state, wherein the ink cartridge comprises a main body having a chamber configured to store ink, an ink outlet portion configured to direct the ink from the chamber to an exterior of the main body of the ink cartridge, and an ink detecting portion configured to detect the ink stored in the ink chamber, the adaptor comprising:

a main body comprising a particular surface, an electrical interface facing a particular direction and disposed on the particular surface, and a first opening configured to expose the ink detecting portion to an exterior of the main body of the adaptor in the attached state.

2. The adaptor according to claim 1, wherein the adaptor is configured to cover the main body of the ink cartridge in the attached state.

3. The adaptor according to claim 1, wherein the adaptor further comprises a further surface perpendicular to the particular surface, and wherein the first opening is provided in the further surface.

4. The adaptor according to claim 3, wherein a second opening is provided in the further surface, wherein the second opening is configured to expose the ink outlet portion of the ink cartridge to the exterior of the main body of the adaptor in the attached state, and wherein the first opening is disposed downstream from the second opening in the particular direction.

5. The adaptor according to claim 1, wherein the electrical interface further comprises a memory configured to store color information of the ink stored in the ink cartridge.

6. An adaptor configured to attach with an ink cartridge in an attached state, wherein the ink cartridge comprises a main body having a chamber configured to store ink, an ink outlet portion disposed on a surface of the main body of the ink cartridge and configured to direct ink from the chamber to an exterior of the main body of the ink cartridge, and a light attenuating portion protruding from the surface of the main body of the ink cartridge, the adaptor comprising:

a main body comprising a surface, an electrical interface facing a particular direction and disposed on the surface of the main body of the adaptor, and a first opening configured to expose the light attenuating portion to an exterior of the main body of the adaptor in the attached state.

7. The adaptor according to claim 6, wherein the adaptor is configured to cover the main body of the ink cartridge in the attached state.

8. The adaptor according to claim 6, wherein the adaptor further comprises a further surface perpendicular to the surface of the main body of the adaptor, and wherein the first opening is provided in the further surface.

9. The adaptor according to claim 8, wherein a second opening is provided in the further surface further, wherein the second opening is configured to expose the ink outlet portion of the ink cartridge to the exterior of the main body of the adaptor in the attached state, and wherein the first opening is disposed downstream from the second opening in the particular direction.

10. The adaptor according to claim 6, wherein the electrical interface further comprises a memory configured to store color information of the ink stored in the ink cartridge.

11. An adaptor configured to attach with a cartridge accommodating portion in an attached state, wherein the cartridge accommodating portion comprises an electrical contact and an optical sensor having a light-emitting element and a light-receiving element separated from the light emitting element, the adaptor comprising:

a main body comprising a first surface, an electrical interface facing a first direction and disposed on the first surface, the electrical interface configured to be electrically connected to the electrical contact of the cartridge accommodating portion in the attached state; and a first opening configured to face a space between the light-emitting element and the light-receiving element in the attached state.

12. The adaptor according to claim 11, wherein the first opening faces a second direction perpendicular to the first direction, and wherein the first opening faces the space between the light-emitting element and the light-receiving element in the second direction in the attached state.

13. The adaptor according to claim 12, wherein the adaptor further comprises a second surface perpendicular to the first surface, and wherein the first opening is provided in the second surface.

14. The adaptor according to claim 13, wherein the second surface faces the light-emitting element and the light-receiving element in the attached state.

15. The adaptor according to claim 12, wherein the first opening is a first distance from the electrical interface in the first direction, wherein the first distance is less than a second distance from the electrical interface to an ink tube in the first direction in the attached state, and wherein the ink tube is disposed at one side of the cartridge accommodating portion in the second direction in the attached state.

16. The adaptor according to claim 15 further comprising a second opening formed in the adaptor, wherein the first opening is disposed between the optical sensor and the second opening in the second direction in the attached state.

17. The adaptor according to claim 16, wherein the electrical interface is configured to electrically connect to the electrical contact of the cartridge accommodating portion in the attached state when the adaptor is in an unattached state with an ink cartridge.

18. The adaptor according to claim 17, wherein the electrical interface is configured to electrically connect to the electrical contact of the cartridge accommodating portion in the attached state when the adaptor is in an attached state with the ink cartridge.

* * * * *